US008588666B2

(12) United States Patent
Hagari

(10) Patent No.: US 8,588,666 B2
(45) Date of Patent: Nov. 19, 2013

(54) IMAGE FORMING APPARATUS WITH A MOVABLE PRIMARY TRANSFER ROLLER

(75) Inventor: Yasunori Hagari, Akiruno (JP)

(73) Assignees: Casio Electronics Manufacturing Co., Ltd., Tokyo (JP); Casio Computer Co., Ltd., Tokyo (JP)

( * ) Notice: Subject to any disclaimer, the term of this patent is extended or adjusted under 35 U.S.C. 154(b) by 364 days.

(21) Appl. No.: 13/112,085

(22) Filed: May 20, 2011

(65) Prior Publication Data

US 2011/0286773 A1 Nov. 24, 2011

(30) Foreign Application Priority Data

May 24, 2010 (JP) ..... 2010-118434
Nov. 4, 2010 (JP) ..... 2010-247488

(51) Int. Cl.
*G03G 15/01* (2006.01)

(52) U.S. Cl.
USPC ..... 399/302

(58) Field of Classification Search
USPC ..... 399/121, 298, 299, 302
See application file for complete search history.

(56) References Cited

U.S. PATENT DOCUMENTS

| | | | | |
|---|---|---|---|---|
| 7,400,852 | B2 * | 7/2008 | Furukawa | 399/302 |
| 7,787,809 | B2 * | 8/2010 | Kitagawa | 399/299 |
| 8,374,526 | B2 * | 2/2013 | Ju et al. | 399/121 |

FOREIGN PATENT DOCUMENTS

| | | | |
|---|---|---|---|
| JP | 09-152791 | A | 6/1997 |
| JP | 2001-296760 | A | 10/2001 |
| JP | 2003-186313 | A | 7/2003 |
| JP | 2005-148187 | A | 6/2005 |
| JP | 2007-310024 | A | 11/2007 |
| JP | 2009-169273 | A | 7/2009 |

OTHER PUBLICATIONS

Japanese Office Action dated Nov. 6, 2012 (and English translation thereof) in counterpart Japanese Application No. 2010-247488.

* cited by examiner

*Primary Examiner* — William J Royer
(74) *Attorney, Agent, or Firm* — Holtz, Holtz, Goodman & Chick, PC

(57) ABSTRACT

Provided is an image forming apparatus whose primary transfer roller is structured in a way as to move from a transfer position along a locus of a rotational motion of a radius r about a rotational center of a photosensitive drum as a rotational axis so that the transfer position is set to a position shifted downstream in a belt moving direction from a position of contact between the photosensitive drum and an intermediate transfer belt by a shift amount f. Accordingly, even when there is an error the upward/downward movement of the primary transfer roller to shift the position of contact, the distance of the primary transfer roller from the circumferential surface of the photosensitive drum is constant, so that the shift amount f which is the tangent of the circumferential surface of the photosensitive drum and the circumferential surface of the primary transfer roller is always set constant.

3 Claims, 7 Drawing Sheets

IMAGE FORMING APPARATUS WITH A MOVABLE PRIMARY TRANSFER ROLLER

CROSS REFERENCE TO RELATED APPLICATION

This application claims the benefit of Japanese Patent Application No. 2010-118434, filed on May 24, 2010, and Japanese Patent Application No. 2010-247488, filed on Nov. 4, 2010, the entire disclosures of which are incorporated by reference herein.

FIELD

The present invention relates to an electrophotographic image forming apparatus, and, more particularly, an image forming apparatus which can always accurately set an amount of shifting of a primary transfer roller at a transfer position in a shift type primary transfer from a position of contact between an intermediate transfer belt and a photosensitive drum.

BACKGROUND

Conventionally, there is an electrophotographic image forming apparatus. Generally this image forming apparatus electrifies a photosensitive drum uniformly to initialize the photosensitive drum, and forms an electrostatic latent image on the photosensitive drum by optical writing. The image forming apparatus transforms the electrostatic latent image to a toner image, which is in turn transferred onto a transfer material, such as a sheet of paper, directly or indirectly, and is fixed by a fixing unit.

In the system of indirectly transferring an image on a transfer member, first, primary transfer of a toner image on the circumferential surface of the photosensitive drum onto an intermediate transfer belt unit is carried out, and then secondary transfer of the toner image onto a sheet of paper from the intermediate transfer belt unit is carried out. The systems of primary transfer onto the intermediate transfer belt unit include a direct pressure type and a shift type.

FIG. 7A is a diagram schematically and exemplarily illustrating the structural relation among the conventional direct pressure type primary transfer roller, the intermediate transfer belt and the photosensitive drum. FIG. 7B is a diagram schematically and exemplarily illustrating the structural relation among the conventional shift type primary transfer roller, the intermediate transfer belt and the photosensitive drum.

While a photosensitive drum 7, an intermediate transfer belt 14 and a primary transfer roller 18 shown in FIGS. 7A and 7B have conventional structures, they are given the same reference numerals as those of the components of an image forming apparatus according to an embodiment of the invention to be described later which have similar functions.

According to the direct pressure type configuration shown in FIG. 7A, a nip width a formed with respect to the intermediate transfer belt 14 by the photosensitive drum 7 and primary transfer roller 18 is narrow, and a transfer pressure b is high, whereas according to the shift type configuration shown in FIG. 7B, a nip width c is wide, and a transfer pressure d is low.

A positional deviation (shift) amount f from the position where the photosensitive drum 7 and intermediate transfer belt 14 in FIG. 7B contact each other to the top surface of the primary transfer roller 18 is the value that forms a coefficient called "wind-around amount" in a certain calculation equation at the time of checking the transfer coefficient or the like from the other side.

The concept of "wind-around amount" comes from the fact that the state where the nip width c in the shift type becomes wider than the nip width a in the direct type is called "winding of the intermediate transfer belt around the photosensitive drum" in the field of design.

Since the shift amount f which is provided when the primary transfer roller 18 is shifted from a non-transfer position 18*b* to a transfer executing position 18*a* is an important factor that affects the action of a transfer voltage to be applied to the intermediate transfer belt 14 from the primary transfer roller 18, the shift amount f should be set accurately.

This shift amount f important to the primary transfer depends on a vertical movement amount g of the primary transfer roller 18. When the vertical movement amount g of the primary transfer roller 18 changes, therefore, the shift amount f changes, influencing the transfer state. In other words, unless the vertical movement amount g is accurately set, the adequate transfer cannot be achieved.

To accurately make the vertical movement by the vertical movement amount g to accurately set the shift amount f, it is necessary to considerably improve the accuracy of a device or structure that supports a shaft of the primary transfer roller 18. If this accuracy drops or the vertical movement amount g or the shift amount f changes during transfer, the transfer state changes, causing deficiency, such as spots, on the transferred image.

The image forming apparatuses proposed in Unexamined Japanese Patent Application KOKAI Publication Nos. H09-152791, 2001-296760 and 2007-310024 are configured to have the primary transfer roller disposed downstream of the photosensitive drum.

Although each of the publications describes positioning of the primary transfer roller at the time of transfer, however, it does not give a clear description on the setting of the shift amount f, leaving unattended the issue on how to keep the shift amount f constant.

SUMMARY

Accordingly, it is an object of the present invention to provide an image forming apparatus including a primary transfer roller disposed opposite to a photosensitive drum with an intermediate transfer belt in between to carry out primary transfer of a toner image on the photosensitive drum to the intermediate transfer belt, wherein even with a slight error present in a moving mechanism, the shift amount can be kept constant.

To achieve the object of the invention, an image forming apparatus according to the invention is configured to include a primary transfer roller disposed opposite to a photosensitive drum with an intermediate transfer belt in between to carry out primary transfer of a toner image on the photosensitive drum to the intermediate transfer belt, wherein when moving from a non-transfer position to a transfer position to carry out the primary transfer of the toner image onto the intermediate transfer belt, the primary transfer roller is moved along a locus of a rotational motion about a rotating shaft of the photosensitive drum as a fulcrum so that the transfer position is set to a position shifted downstream in a belt moving direction from a position of contact between the photosensitive drum and the intermediate transfer belt by a predetermined distance.

The image forming apparatus with the foregoing configuration according to the invention is configured so that, for example, the primary transfer roller has a rotating shaft coupled to the rotating shaft of the photosensitive drum by a coupling member, the rotating shaft of the primary transfer roller is coupled to the coupling member and a cam interlocking member disposed in a belt unit, and the cam interlocking member is moved back and forth by a rotating cam in contact with a cam surface thereof in a slidable manner, thus causing the rotating shaft of the primary transfer roller to move along an arc locus of the rotational motion about the rotating shaft of the photosensitive drum as the fulcrum according to the forward/backward movement of the cam interlocking member.

The image forming apparatus with the foregoing configuration according to the invention is configured so that, for example, the image forming apparatus has at least two rotating members, the primary transfer roller is held by a cam interlocking member disposed in a belt unit, the cam interlocking member is moved back and forth by a rotating cam in contact with a cam surface thereof in a slidable manner, and is supported by support shafts on one ends of the rotating members at a side surface at right angles to a direction in which the cam interlocking member is moved forward and backward, and supported shafts on other ends of the rotating members are fixed to a frame of the belt unit to be rotatably supported, a distance between a point of support of the support shaft and a supported point of the supported shaft being equal to a distance between the center of the rotating shaft of the photosensitive drum and an arc of an arc locus, along which the rotating shaft of the primary transfer roller moves, of the rotational motion about the rotating shaft of the photosensitive drum as the fulcrum.

As apparent from the above, the image forming apparatus of the present invention, though simple its configuration is, can demonstrate an effect of always keeping the shift amount constant even with a slight error present in the moving mechanism.

BRIEF DESCRIPTION OF THE DRAWINGS

A more complete understanding of this application can be obtained when the following detailed description is considered in conjunction with the following drawings, in which.

DETAILED DESCRIPTION

Hereafter, embodiments of the present invention will be described in detail referring to the accompanying drawings.

First Embodiment

Figure 1:
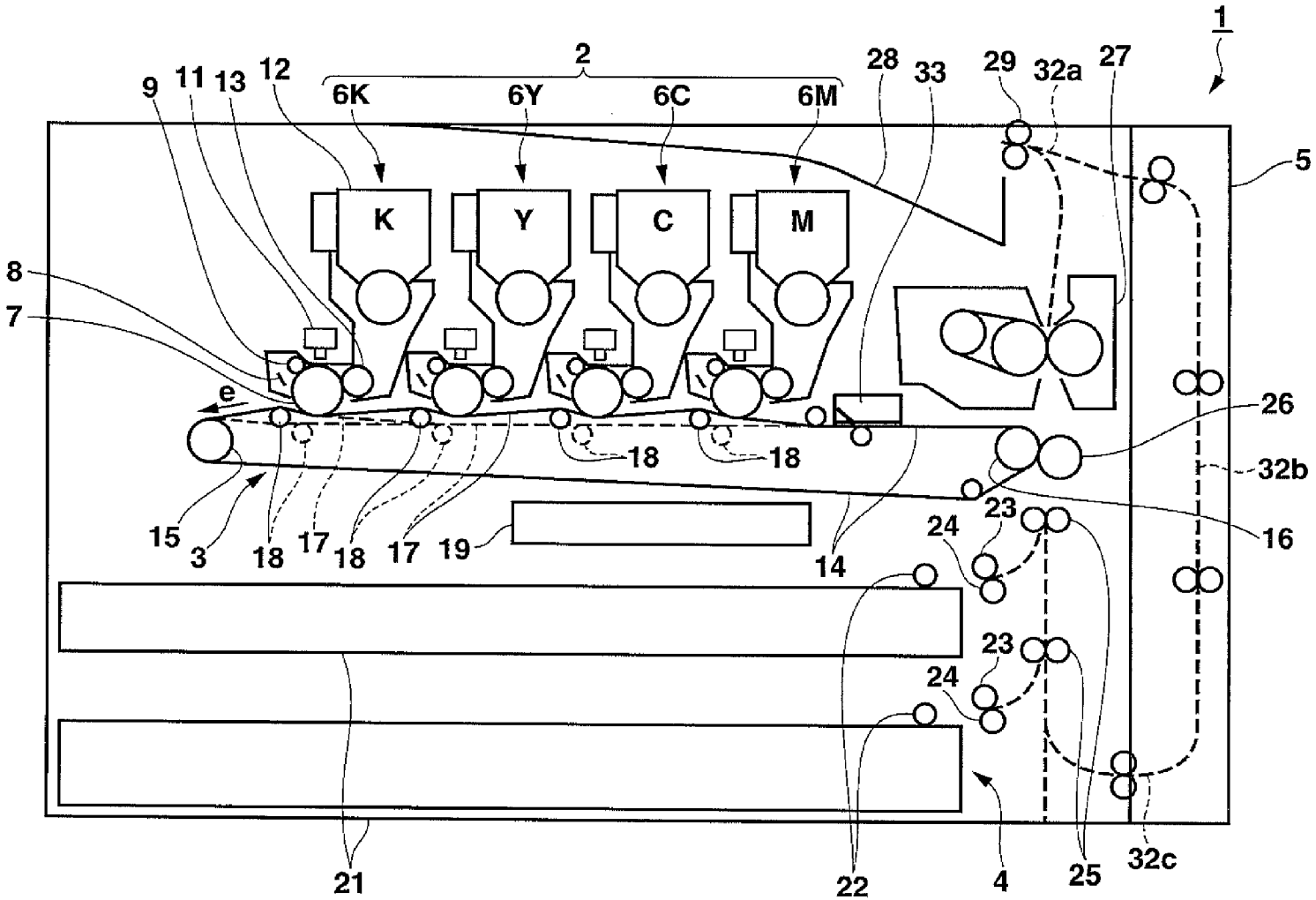
FIG. 1 is a cross-sectional view illustrating the internal configuration of a full color image forming apparatus (printer) according to a first embodiment of the invention.

FIG. 1 is a cross-sectional view illustrating an internal configuration of a full color image forming apparatus 1 (hereinafter simply called "printer") according to a first embodiment of the invention.

The printer 1 shown in FIG. 1 is a tandem type electrophotographic color image forming apparatus of a secondary transfer type, and includes an image forming part 2, an intermediate transfer belt unit 3, a sheet feeding part 4, and a double-side-print conveying unit 5.

The image forming part 2 includes four image forming units 6 (6M, 6Y, 6C, 6K) disposed side by side in multiple stages from the right to the left in the diagram.

Among the four image forming units 6, the three image forming units 6M, 6C, and 6Y on the upstream side (right-hand side in the diagram) form monocolor images formed by color toners of magenta (M), cyan (C), and yellow (Y), which are subtractive primary colors, respectively, and the image forming unit 6K forms a monochrome image formed by a black (K) toner which is used mainly for dark portions or the like of a character and an image.

All of the image forming units 6 have the same configuration except for the colors of the toners stored in the respective toner containers (toner cartridges). Therefore, the configuration of the image forming unit 6K for black (K) will be described by way of example.

The image forming unit 6 includes a photosensitive drum 7 at the bottommost portion. This photosensitive drum 7 has its peripheral surface formed of, for example, an organic photoconductivity material. A cleaner 8, a charge roller 9, an optical writing head 11, and a developing roller 13 of a developing unit 12 are disposed near and around the peripheral surface of the photosensitive drum 7.

The developing unit 12 retains one of magenta (M), cyan (C), yellow (Y) and black (K) toners, as indicated by M, C, Y and K, in a toner container located at the upper portion, and includes a toner replenishing mechanism provided at a middle portion to supply the toner downward.

The developing unit 12 is provided with the developing roller 13 at a side opening portion of its lower portion, and includes inside a toner agitating member, a toner feed roller which supplies the toner to the developing roller 13, a doctor blade which restricts the toner layer on the developing roller 13 to a given thickness, and the like, though not particularly illustrated.

The intermediate transfer belt unit 3 includes an endless intermediate transfer belt 14 extending in a flat loop from nearly the left end to the right end in FIG. 1 almost in the center of a printer body, and a driving roller 15 and a follower roller 16 around which the intermediate transfer belt 14 is put and is moved counterclockwise in the diagram.

A toner image is directly transferred to the belt surface of the intermediate transfer belt 14 (primary transfer). Since the transferred toner image is conveyed to the transfer position to be further transferred to a sheet of paper (secondary transfer), the whole unit is called an "intermediate transfer belt unit".

This intermediate transfer belt unit 3 includes a belt-position control mechanism 17 within the loop of the loop-like flat intermediate transfer belt 14. The belt-position control mechanism 17 has three primary transfer rollers 18 which are formed of a conductive foamed sponge and are pressed against the lower peripheral surface of the photosensitive drum 7 via the intermediate transfer belt 14.

The belt-position control mechanism 17 rotates the three primary transfer rollers 18 corresponding to the three image forming units 6M, 6C, and 6Y of magenta (M), cyan (C), and yellow (Y) about the support shafts in the same cycle.

Then, the belt-position control mechanism 17 rotates one primary transfer roller 18 corresponding to the image forming unit 6K of black (K) separately from the aforementioned three primary transfer rollers 18 to separate the intermediate transfer belt 14 from the photosensitive drum 7.

Namely, the belt-position control mechanism 17 changes the position of the intermediate transfer belt 14 of the intermediate transfer belt unit 3 to a full color mode (all of the four primary transfer rollers 18 abut on the intermediate transfer belt 14), a monochrome mode (only the primary transfer roller 18 corresponding to the image forming unit 6K abuts on the intermediate transfer belt 14), and a whole non-transfer mode (all of the primary transfer rollers 18 are separated from the intermediate transfer belt 14).

The intermediate transfer belt unit 3 has a belt cleaner unit disposed on its top side portion, further upstream of the image forming unit 6M located on the uppermost stream side in the belt moving direction. The intermediate transfer belt unit 3 has a thin and flat waste-toner collecting unit 19 detachably disposed on its bottom side portion so as to extend almost all along the entire surface of the bottom side.

The sheet feeding part 4 includes two sheet cassettes 21 arranged in two levels vertically, and has a sheet pick-up roller 22, a feed roller 23, a sweep roller 24 and a pair of standby conveying rollers 25 disposed near the sheet feed port (rightward in FIG. 1) of each of the two sheet cassettes 21.

A secondary transfer roller 26 which is pressed against the follower roller 16 via the intermediate transfer belt 14 is disposed in the sheet conveying direction (vertically upward in FIG. 1) of the standby conveying rollers 25 to form a secondary transfer part with respect to a sheet of paper.

A belt type heat fixing unit 27 is disposed at a downstream side (upward in FIG. 1) of this secondary transfer part. Provided further downstream of the belt type heat fixing unit 27 is a pair of sheet ejecting rollers 29 which takes out a sheet of paper after fixing from the belt type heat fixing unit 27, and delivers the sheet of paper to a sheet output tray 28 formed on the top surface of the printer 1.

The outer surface (right outer side in FIG. 1) of the double-side-print conveying unit 5 also serves as an opening/closing member as a right side cover which opens or shields the interior of the printer 1 to or from the outside.

The double-side-print conveying unit 5 has a start return path 32*a* which is branched laterally rightward in FIG. 1 from a conveyance path at a middle portion between the belt type heat fixing unit 27 and the sheet ejecting rollers 29, a middle return path 32*b* bent downward from the start return path 32*a*, and an end return path 32*c* which turns horizontally leftward opposite to those paths, and finally flips a return sheet of paper.

The outlet of the end return path 32*c* is connected to a conveyance path to the standby conveying rollers 25 corresponding to the lower sheet cassette 21 of the sheet feeding part 4. In this example, a cleaning part 33 is disposed on the top surface portion of the intermediate transfer belt unit 3.

The cleaning part 33 abuts on the upper surface of the intermediate transfer belt 14 to scrape off waste toner to be stored in a temporary storage section of the belt cleaner unit (not shown). The stored waste toner is conveyed upward inside a fall pipe by a conveying screw, and is fed into the waste-toner collecting unit 19 via the fall pipe.

Figure 2A:
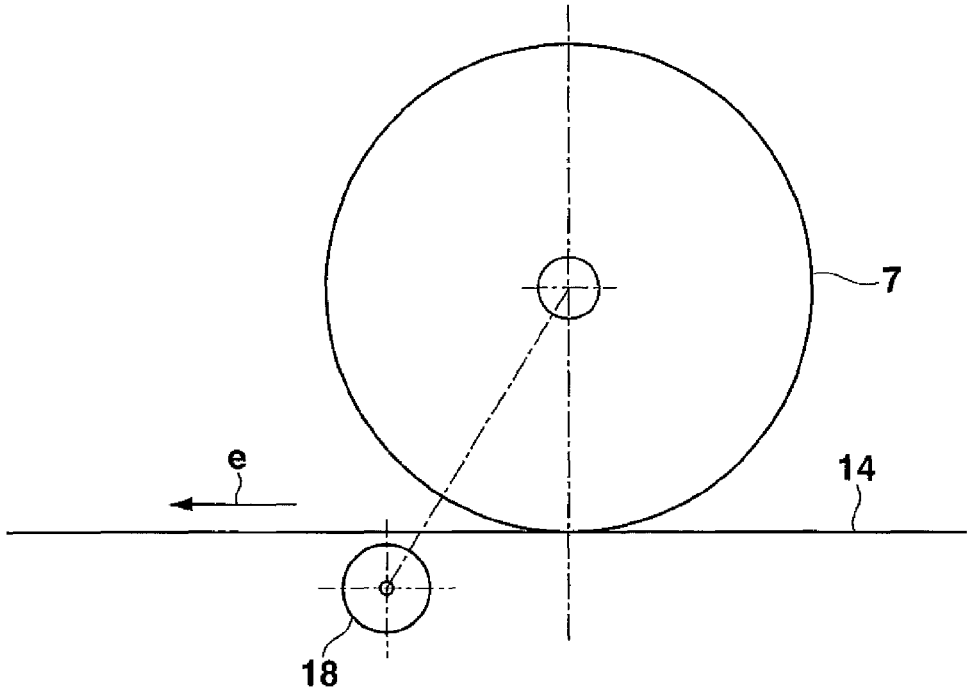
FIGS. 2A and 2B are simplified diagrams exemplarily showing the structural relation among a shift type primary transfer roller, an intermediate transfer belt and a photosensitive drum in the configuration of the printer according to the first embodiment.
Figure 2B:
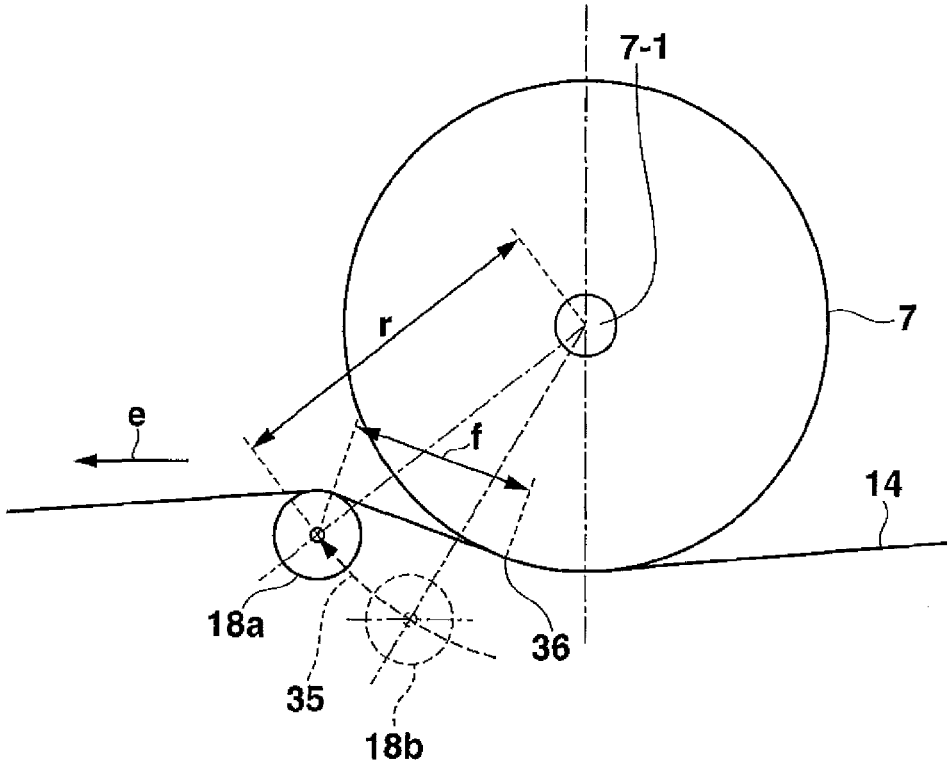

FIGS. 2A and 2B are simplified diagrams exemplarily showing the structural relation among the shift type primary transfer roller 18, the intermediate transfer belt 14 and the photosensitive drum 7 in the configuration of the image forming apparatus 1. In FIGS. 2A and 2B, the intermediate transfer belt 14 cyclically moves in the direction of an arrow e. That is, the primary transfer roller 18 is shifted downstream to the photosensitive drum 7 in FIGS. 2A and 2B.

FIG. 2A shows a case where the primary transfer roller 18 is at a non-transfer position (standby position) 18*b*, and FIG. 2B shows a case where the primary transfer roller 18 is moved from the non-transfer position 18*b* and located at a transfer position 18*a*. The movement of the primary transfer roller 18 between the non-transfer position 18*b* and the transfer position 18*a* is carried out by some moving mechanism.

In this embodiment, the movement of the primary transfer roller 18 between the non-transfer position 18*b* and the transfer position 18*a* is carried out along a locus 35 of the rotational motion of a radius r about a rotational center 7-1 of the photosensitive drum 7 as the rotational axis.

Accordingly, the transfer position of the primary transfer roller 18 is set to a position shifted downstream of a contact position 36 between the photosensitive drum 7 and the intermediate transfer belt 14 in the belt moving direction indicated by the arrow e by a distance of a shift amount f.

When an error occurs in the movement of the primary transfer roller 18 in the up and down direction in the action of the primary transfer roller 18 to the transfer position 18*a* (belt winding action) in the embodiment, the contact position 36 between the photosensitive drum 7 and the intermediate transfer belt 14 moves according to this error.

Since the primary transfer roller 18 is moved along the locus 35 of the rotational motion of the radius r, however, the distance of the primary transfer roller 18 from the circumferential surface of the photosensitive drum 7 is constant. That is, the shift amount f which is the tangent of the circumferential surface of the photosensitive drum 7 and the circumferential surface of the primary transfer roller 18.

According to the embodiment, as apparent from the above, even if there is an error in the position at which the action of the primary transfer roller 18 stops, the shift amount f which is an important dimensional value does not change as long as the erroneous position lies within the range of the rotation between the non-transfer position 18*b* and the transfer position 18*a*. This provides stable transfer results.

Since the shift amount of the primary transfer roller relative to the photosensitive drum at the time of transfer can be kept constant irrespective of an error in the rolling stop position according to the embodiment, it is possible to always acquire stable transfer results.

Second Embodiment

Figure 3:
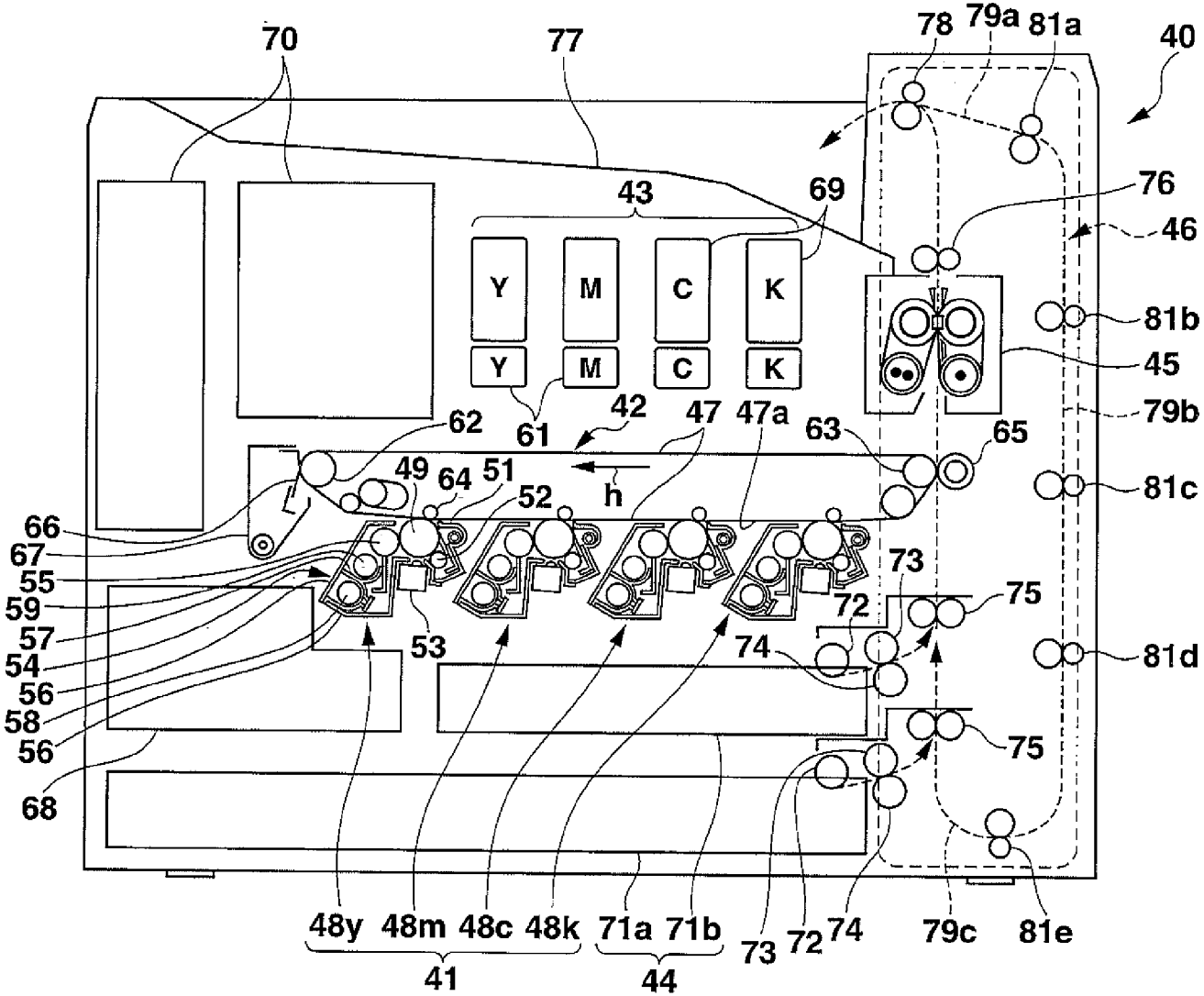
FIG. 3 is a cross-sectional view illustrating the internal configuration of a full color image forming apparatus (printer) according to second and third embodiments of the invention.

FIG. 3 is a cross-sectional view illustrating an internal configuration of a full color image forming apparatus 40 (hereinafter simply called "printer") according to a second embodiment.

The printer 40 shown in FIG. 3 is a tandem type electrophotographic color image forming apparatus of a secondary transfer type, and includes an image forming part 41, a transfer belt unit 42, a toner feeding part 43, a sheet feeding part 44, a belt type heat fixing unit 45, and a double-side-print conveying unit 46.

The image forming part 41 includes four developing devices 48 (48*m*, 48*c*, 48*y*, 48*k*) disposed side by side in multiple stages from the right to the left in FIG. 3 in contact with a lower running surface 47*a* of an intermediate transfer belt 47 of the transfer belt unit 42. This image forming part 41 is held on the frame of the body of the printer 40 in such a way as to be elevatable from a print executing position shown in FIG. 3 to a maintenance position set lower than the print executing position.

Among the four developing devices 48, the three developing devices 48*m*, 48*c* and 48*y* on the downstream side (right-hand side in FIG. 3) form monocolor images formed by color toners of magenta (M), cyan (C), and yellow (Y), which are subtractive primary colors, respectively, and the developing device 48*k* forms a monochrome image formed by a black (K) toner which is used mainly for dark portions or the like of a character and an image.

All of the developing devices 48 have the same configuration except for the colors of the respective toners to develop images. Therefore, the configuration of the developing device 48*y* for yellow (Y) will be described by way of example.

The developing device 48 includes a photosensitive drum 49 at the topmost portion. This photosensitive drum 49 has its peripheral surface formed of, for example, an organic photoconductivity material. A cleaner 51, a charge roller 52, an optical writing head 53, and a developing roller 55 of a developing unit 54 are disposed near and around the peripheral surface of the photosensitive drum 49.

The developing unit 54 includes a casing 56 covering the outer portion, a partition 57 provided inside, the developing roller 55, a first agitating/conveying screw 58, and a second agitating/conveying screw 59. Though not particularly illustrated, each of the first and second agitating/conveying screws 58 and 59 comprises a screw shaft, and a fin which is formed integral with the screw shaft to rotate.

The developing unit 54 is supplied with one of yellow (Y), magenta (M), cyan (C) and black (K) toners, as indicated by Y, M, C and K in FIG. 3, from a reserve tank 61 of the toner feeding part 43.

The transfer belt unit 42 includes the endless intermediate transfer belt 47 extending in a flat loop in the left and right direction in FIG. 3 almost in the center of the printer body, and a driving roller 62 and a follower roller 63 around which the intermediate transfer belt 47 is put and is moved counter-clockwise as indicated by an arrow h in FIG. 3.

A toner image is directly transferred to the belt surface of the intermediate transfer belt 47 (primary transfer) which cyclically moves below by a primary transfer roller 64 which is integrally installed in the transfer belt unit 42 to be pressed against the photosensitive drum 49 via the intermediate transfer belt 47. To further transfer this toner image to a sheet of paper (secondary transfer), the toner image is conveyed to a secondary transfer part where a secondary transfer roller 65 is pressed against the follower roller 63 via the intermediate transfer belt 47.

A belt cleaner 67 having a cleaning blade 66 which abuts on the top surface of the intermediate transfer belt 47 is disposed at the transfer belt unit 42. A waste-toner collecting unit 68 is detachably disposed under the belt cleaner 67.

The cleaning blade 66 of the belt cleaner 67 abuts on the top surface of the intermediate transfer belt 47 to scrape off the waste toner, and feeds the waste toner to the underlying waste-toner collecting unit 68 by a conveying screw.

The toner feeding part 43 includes four reserve tanks 61 indicated by Y, M, C and K, arranged above the upper running section of the intermediate transfer belt 47, left to right, and toner cartridges 69 for toner supplement, indicated by Y, M, C and K, detachably disposed above those reserve tanks 61.

The four toner cartridges 69 respectively retain yellow (Y) toner, magenta (M) toner, cyan (C) toner, and black (K) toner, and four reserve tanks 61 are supplemented with the toners from the toner cartridges 69 respectively mounted thereabove.

Those four reserve tanks 61 are coupled to the developing units 54 of the corresponding developing devices 48 by the respective toner feeding paths, though the developing units 54 are hidden behind the transfer belt unit 42 in FIG. 3.

This toner feeding part 43, not particularly illustrated, is held to the frame of the body of the printer 40 in such a way as to be elevatable from the print executing position shown in FIG. 3 to the maintenance position set thereabove.

Two electrical component parts 70 are provided to be left of the toner feeding part 43, extending from the left of the belt cleaner 67 to above the driving roller 62. The electrical component part 70 includes a circuit board on which a control device comprising a plurality of electronic parts is mounted.

The sheet feeding part 44 includes two sheet cassettes 71 (71*a*, 71*b*) arranged in two levels vertically. A sheet pick-up roller 72, a feed roller 73, a sweep roller 74 and a pair of standby conveying rollers 75 are disposed near the sheet feed port (rightward in FIG. 3) of each of the two sheet cassettes 71.

The aforementioned secondary transfer roller 65 which is pressed against the follower roller 63 via the intermediate transfer belt 47 is disposed in the sheet conveying direction (vertically upward in FIG. 3) of the standby conveying rollers 75 to form the aforementioned secondary transfer part with respect to a sheet of paper.

The belt type heat fixing unit 45 is disposed at a downstream side (upward in FIG. 3) of this secondary transfer part. Provided further downstream of the belt type heat fixing unit 45 are a pair of feed-out rollers 76 which feeds out a sheet of paper after fixing from the belt type heat fixing unit 45, and a pair of sheet ejecting rollers 78 which delivers the fed-out sheet of paper to a sheet output tray 77 formed on the top surface of the printer.

The outer surface (right outer side in FIG. 3) of the double-side-print conveying unit 46 also serves as an opening/closing member which opens or shields the interior of the printer 40 to or from the outside.

The double-side-print conveying unit 46 has a return path including a start return path 79*a* which is branched laterally rightward in FIG. 3 from a conveyance path directly before the sheet ejecting rollers 78, a middle return path 79*b* bent downward from the start return path 79*a*, and an end return path 79*c* which turns horizontally leftward opposite to those paths, and finally flips a return sheet of paper.

Five sets of return roller pairs 81 (81*a*, 81*b*, 81*c*, 81*d*, 81*e*) are disposed in a midway of the return path. The outlet of the return roller pair 81*e* is merged with the conveyance path to the standby conveying rollers 75 corresponding to the lower sheet cassette 71*a* of the sheet feeding part 44.

Figure 4A:
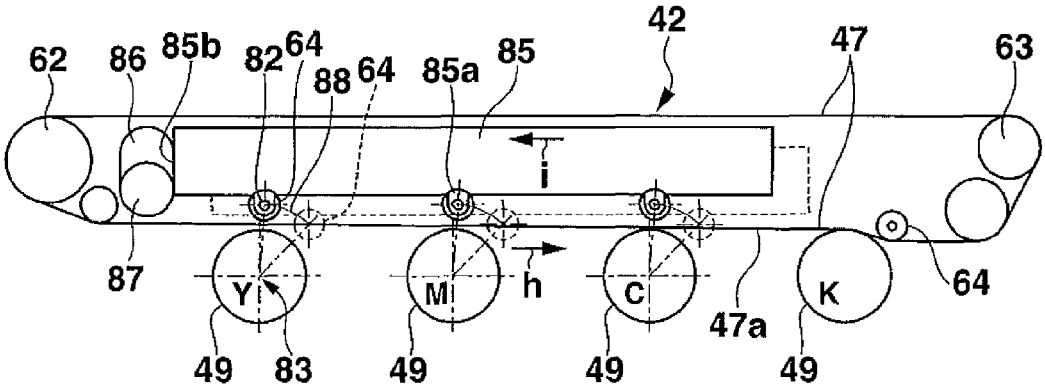
FIGS. 4A and 4B are simplified diagrams exemplarily showing the structural relation among a shift type primary transfer roller, an intermediate transfer belt and a photosensitive drum in the configuration of the printer according to the second embodiment with a coupling member removed as viewed from the front side.
Figure 4B:
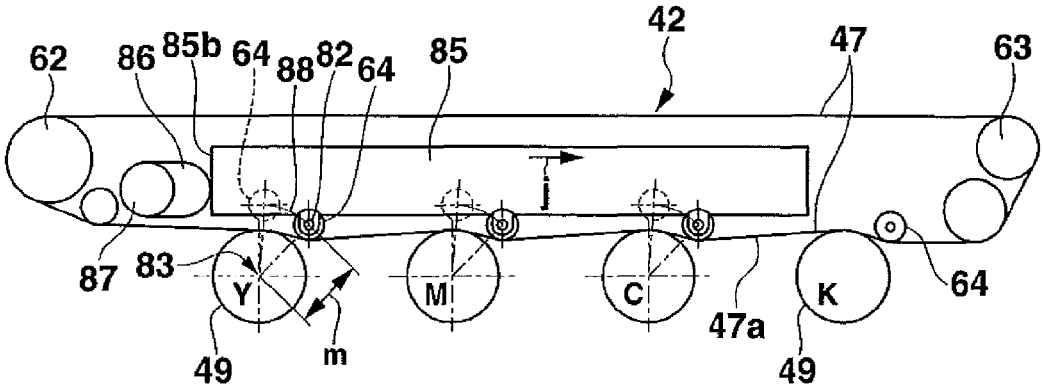
Figure 4C:
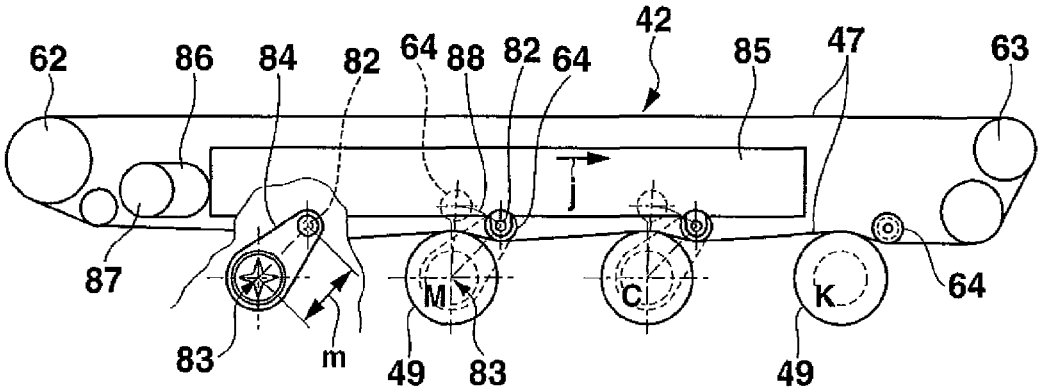
FIG. 4C is a partly cutaway diagram showing the coupling member on one rear side in a solid line and showing a coupling member on the other rear side in a broken line in a see-through manner in the structural relation among the shift type primary transfer roller, the intermediate transfer belt and the photosensitive drum in the configuration of the printer according to the second embodiment.

FIGS. 4A and 4B are simplified diagrams exemplarily showing the structural relation among the shift type primary transfer roller 64, the intermediate transfer belt 47 and the photosensitive drum 49 in the configuration of the printer 40 according to the second embodiment with a coupling member 84 removed as viewed from the front side, and FIG. 4C is a partly cutaway diagram showing the coupling member 84 on one rear side in a solid line and showing the coupling member 84 on the other rear side in a broken line in a see-through manner.

Figure 5A:
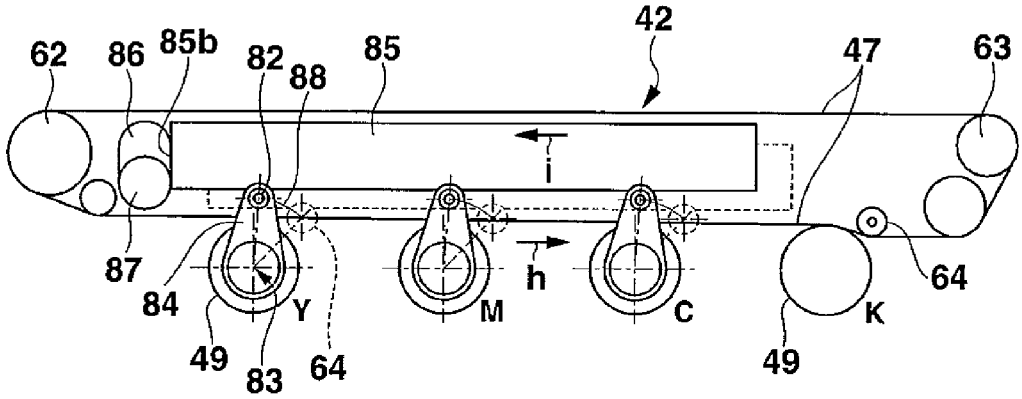
FIGS. 5A and 5B are simplified diagrams exemplarily showing the front-side structural relation among the shift type primary transfer roller, the intermediate transfer belt and the photosensitive drum in the configuration of the printer according to the second embodiment.
Figure 5B:
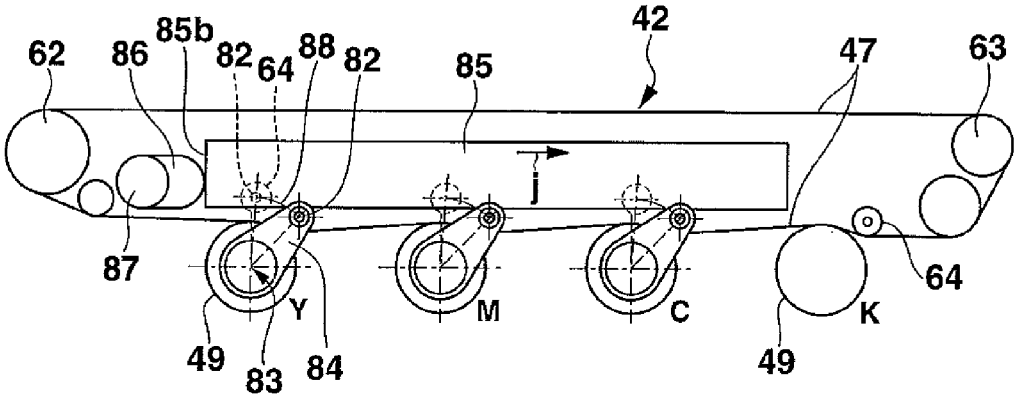
Figure 5C:
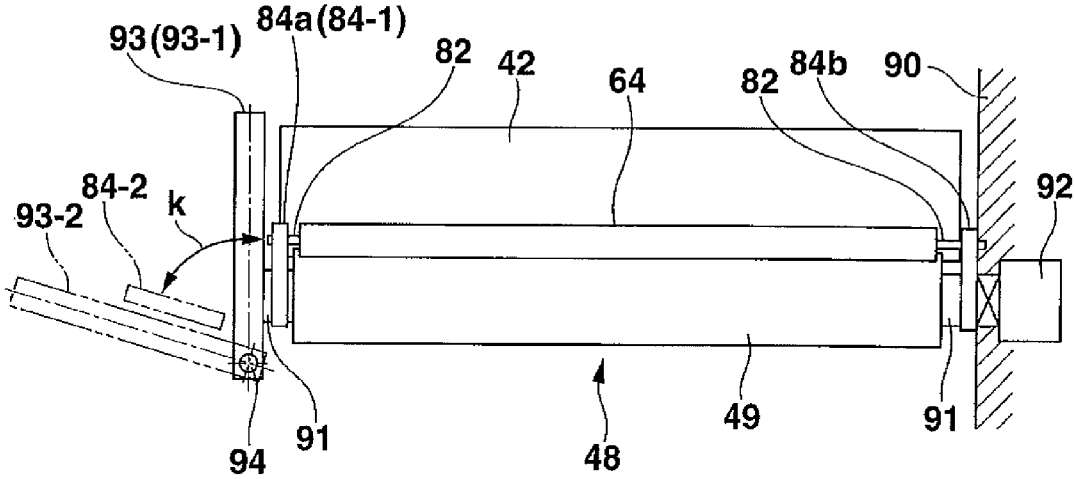
FIG. 5C is a simplified diagram exemplarily showing the structural relation between an opening/closing of a lock cover on the front side of a printer body and a shift mechanism.

FIGS. 5A and 5B are simplified diagrams exemplarily showing the structural relation among the shift type primary transfer roller 64, the intermediate transfer belt 47 and the photosensitive drum 49 as viewed from the front side, and FIG. 5C is a simplified diagram exemplarily showing the structural relation between the opening/closing of the lock cover on the front side of the printer body and the shift mechanism.

FIG. 4A and FIG. 5A show a state where the individual members are at the monochrome transfer position, and FIG. 4B and FIG. 5B show a state where the individual members are at the full-color transfer position.

Same reference numerals are given to those components in FIGS. 4A to 4C and FIGS. 5A to 5C which are the same as the corresponding components shown in FIG. 3. In addition, the photosensitive drums 49 are given suffixes Y, M, C and K to show the correspondence with the colors of the developing toners.

As shown in FIGS. 4A to 4C, FIGS. 5A and 5B, the position of the primary transfer roller 64 disposed with respect to the photosensitive drum 49 corresponding to the color K is invariable, and is set to a position shifted downstream of the contact position between the photosensitive drum 49 and the intermediate transfer belt 47 in the belt moving direction indicated by the arrow h by a predetermined distance.

Each of the other three primary transfer rollers 64 disposed opposite to the photosensitive drums 49 corresponding to Y, M and C has its rotational shaft 82 coupled to a rotational axial center 83 of the photosensitive drum 49 by a coupling member 84.

Each of the rotational shafts 82 of the three primary transfer rollers 64 is coupled to the respective coupling member 84, and is held at a holding part 85*a* of a cam interlocking member 85 disposed inside the transfer belt unit 42.

The cam interlocking member 85 is urged toward the driving roller 62 by an unillustrated urging member. The cam surface of a rotational cam 86 is slidably in contact with a side surface 85*b* of the cam interlocking member 85 which lies on the driving roller 62 side.

The rotational cam 86 is held on a cam shaft 87, and rotates by 90 degrees to a vertical position shown in FIGS. 4A and 5A and a horizontal position shown in FIGS. 4B and 5B as the cam shaft 87 is rotated forward and reversely by an unillustrated driving device.

When the cam surface of the rotational cam 86 is rotated to a position to move away from the side surface 85*b* of the cam interlocking member 85, i.e., when the rotational cam 86 is rotated to the vertical position shown in FIGS. 4A and 5A, the cam interlocking member 85 moves closer to the driving roller 62 as indicated by an arrow i by the urging force of the urging member.

According to this movement, the three primary transfer rollers 64, held on the holding parts 85*a* of the cam interlocking members 85, are also moved closer to the driving roller 62 by the rotational shafts 82.

According to the movements, the top end portions of the rear-side and front-side coupling members 84 coupled to the rotational shafts 82 of the three primary transfer rollers 64 are rotated to upright positions with the rotational axial centers 83 of the respective photosensitive drums 49 as the fulcrums.

As the coupling member 84 is rotated to the upright position, the primary transfer roller 64 coupled to the upper end portion of the coupling member 84 is moved, together with the cam interlocking member 85, to an upper position to move away from the intermediate transfer belt 47. That is, the transfer state becomes the monochrome transfer state.

When the rotational cam 86 is rotated to a position to push the side surface 85*b* of the cam interlocking member 85, i.e., when the rotational cam 86 is rotated to the horizontal position shown in FIGS. 4B and 5B, on the other hand, the cam interlocking member 85 moves away from the driving roller 62 as indicated by an arrow j against the urging force of the urging member.

According to this movement, the three primary transfer rollers 64, held on the holding parts 85*a* of the cam interlocking members 85, are also moved away from the driving roller 62 by the rotational shafts 82.

According to the movements, the top end portions of the rear-side and front-side coupling members 84 coupled to the rotational shaft 82 of the three primary transfer rollers 64 are rotated in the direction to move away from the driving roller 62 by angles matching the amounts of movement of the cam interlocking members 85 with the rotational axial centers 83 of the respective photosensitive drums 49 as the fulcrums.

As the coupling member 84 is rotated in the direction to move away from the driving roller 62, i.e., rotated downstream in the belt moving direction, the primary transfer roller 64 coupled to the upper end portion of the coupling member 84 is moved, together with the cam interlocking member 85, downstream in the belt moving direction.

At this time, the coupling part of the coupling member 84 to the primary transfer roller 64 rotates drawing an arc 88 with the rotational axial center 83 of the photosensitive drum 49 as the fulcrum.

Accordingly, the three primary transfer rollers 64 each move along the arc 88 drawn by the coupling part of the coupling member 84 to the primary transfer roller 64 to a position indicated by a solid line in FIG. 4B (indicated by a broken line in FIG. 4A) from a position indicated by a solid line in FIG. 4A (the primary transfer roller 64 which is to be indicated by a solid line in FIGS. 5A and 5B too is not visible hidden behind the coupling member 84).

As apparent from the above, each of the three primary transfer rollers 64 is set to the position which is shifted downstream of the photosensitive drum 49 in the belt moving direction and where the lower running surface 47*a* of the intermediate transfer belt 47 is pressed against the surface of the photosensitive drum 49. That is, the transfer state becomes the full-color transfer state.

A length m connecting coupling points of the coupling member 84 shown in FIGS. 4B and 4C which couple the primary transfer roller 64 to the photosensitive drum 49 is the same as the radius r to draw the locus 35 of the rotational motion about the rotational center 7-1 of the photosensitive drum 7 described with reference to FIG. 2B as the rotational axis, except that the positional relation among the photosensitive drum 49, the intermediate transfer belt 47 and the primary transfer roller 64 is reversed upside down, and the principle of the shift transfer in this embodiment is the same as that in the case of FIG. 2B.

The coupling action of the coupling member 84 when the developing unit 54 is attached or detached from the body of the image forming apparatus 40 will be described referring to FIG. 5C. FIG. 5C shows a body frame 90 of the printer 40, the transfer belt unit 42, the primary transfer roller 64, a rotational shaft 91 of the photosensitive drum 49, the coupling member 84 (84*a*, 84*b*), a body-side coupling 92, and a lock cover 93.

The lock cover 93 is an opening/closing member to attach and fix the transfer belt unit 42 and the developing device 48 to the body frame 90, and rotates to a lock position 93-1 and an open position 93-2 with a hinge shaft 94 as the fulcrum.

FIG. 5C shows the front-side coupling member 84 by 84*a*, and the rear-side coupling member 84 by 84*b*. The rear-side coupling member 84*b* is temporarily fixed to the body-side coupling 92 in an operable manner.

The rear-side coupling member 84*b* is attached to or detached from the rotational shaft 91 of the photosensitive drum 49 by the attachment or detachment of the developing device 48 to or from the body frame 90, and is attached to or detached from the rotational shaft 82 by the attachment or detachment of the transfer belt unit 42 to or from the body frame 90.

The front-side coupling member 84*a* is temporarily fixed to the lock cover 93 in an operable manner. According to the opening/closing rotation of the lock cover 93, the front-side coupling member 84*a* rotates to an engagement position 84-1 and a disengagement position 84-2 as indicated by a double-headed arrow k.

The front-side coupling member 84*a* couples a rotational shaft 91 of the photosensitive drum 49 to the rotational shaft 82 at the engagement position 84-1, and disconnects the rotational shaft 91 of the photosensitive drum 49 from the rotational shaft 82 at the disengagement position 84-2.

Third Embodiment

Figure 6A:
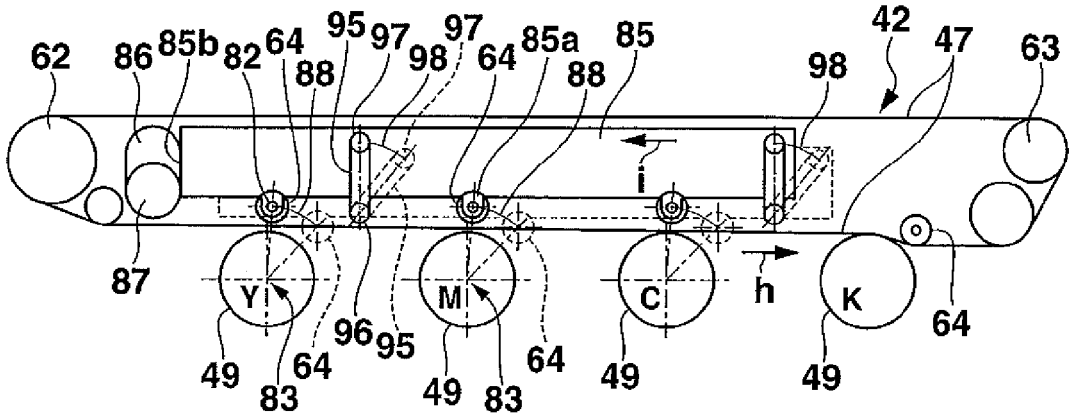
FIGS. 6A and 6B are simplified diagrams exemplarily showing the structural relation among a shift type primary transfer roller, an intermediate transfer belt and a photosensitive drum in the configuration of the printer according to the third embodiment.
Figure 6B:
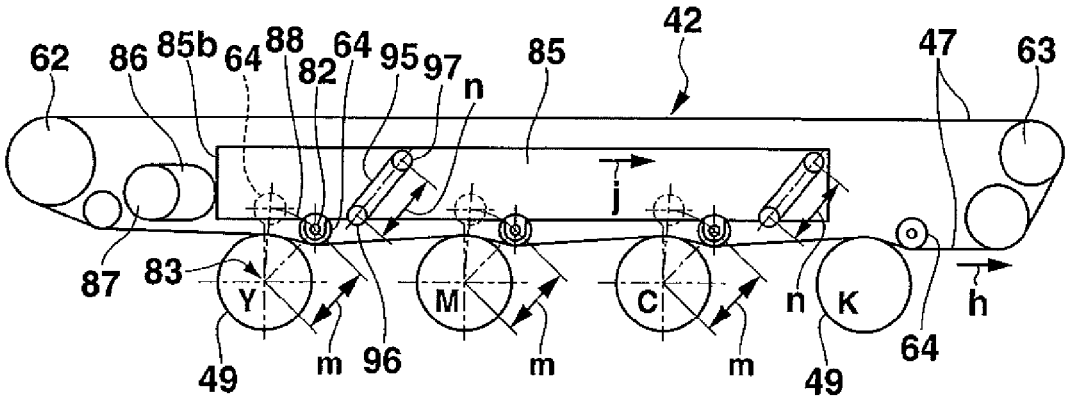
Figure 7A:
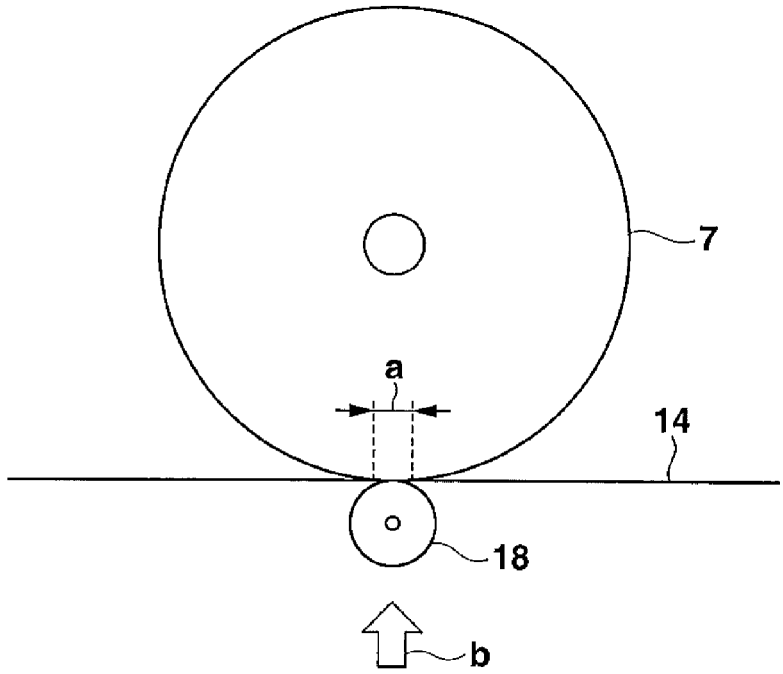
FIG.7A PRIOR ART
FIG. 7A is a simplified diagram exemplarily showing the structural relation among a conventional direct pressure type primary transfer roller, an intermediate transfer belt and a photosensitive drum.
Figure 7B:
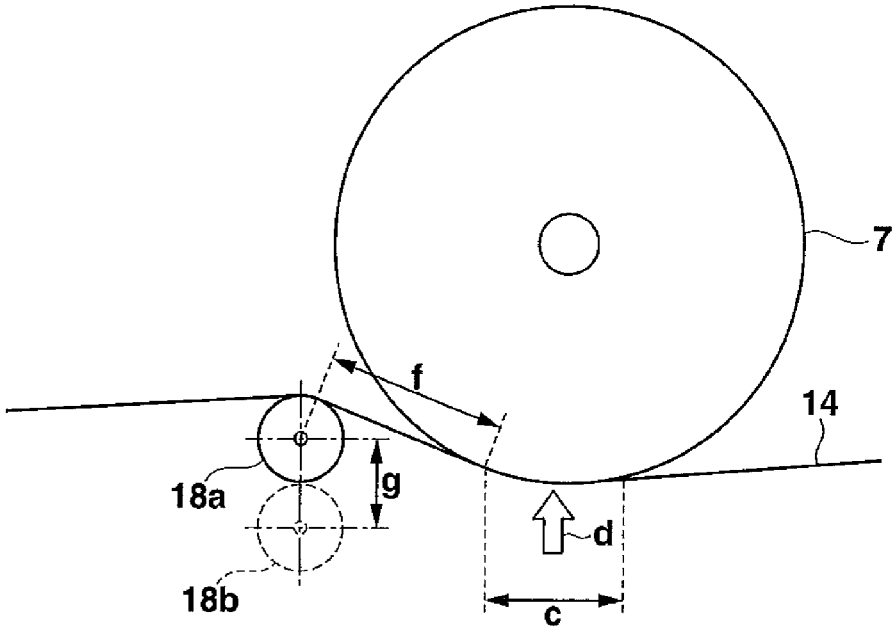
FIG.7B PRIOR ART
FIG. 7B is a simplified diagram exemplarily showing the structural relation among a conventional shift type primary transfer roller, an intermediate transfer belt and a photosensitive drum.

FIGS. 6A and 6B are simplified diagrams exemplarily showing the structural relation among the shift type primary transfer roller, the intermediate transfer belt and the photosensitive drum in the configuration of a printer according to a third embodiment. The configuration of the printer body is the same as that shown in FIG. 3 except for that portion which is associated with the primary transfer roller 64.

Same reference numerals are given to those structural or functional portions in FIGS. 6A and 6B which are the same as the corresponding structural or functional portions shown in FIGS. 4A, 4B, 5A and 5B (hereinafter simply referred to as the corresponding structural or functional portions shown in FIGS. 4A and 4B). FIG. 6A shows a state where the individual members are at the monochrome transfer position, and FIG. 6B shows a state where the individual members are at the full-color transfer position.

The forward and backward movements of the cam interlocking member 85 in the directions indicated by the arrows i and j in response to the action of the rotational cam 86 and the holding of the primary transfer roller 64 on the holding part 85*a* of the cam interlocking member 85 in this embodiment are the same as shown in FIGS. 4A and 4B.

The configuration and action shown in FIGS. 6A and 6B differs from those in FIGS. 4A and 4B in that unlike in FIGS. 4A and 4B, there is no coupling member 84 which couples the shaft of the primary transfer roller 64 to the shaft of the photosensitive drum 49, and two rotating members 95 are provided instead in the third embodiment. Note that the quantity of the rotating members 95 is not limited as long as the quantity is at least two.

In the embodiment, a to-be-supported shaft 96 of the rotating member 95 at the lower end is fixed to the frame of the transfer belt unit 42 to be rotatably supported. A support shaft 97 of the rotating member 95 at the upper end is supported by the rotational cam 86 of the cam interlocking member 85 at its side face in a direction at right angles to the direction where the support shaft 97 is moved forward and backward.

The rotating member 95 is positioned perpendicularly when the rotational cam 86 is at the vertical position shown in FIG. 6A and the cam interlocking member 85 is at the position closest to the driving roller 62. That is, the support shaft 97 at the upper end of the rotating member 95 is at the top of the rotating path.

When the rotational cam 86 is rotated to the horizontal position shown in FIG. 6B from the vertical position shown in FIG. 6A, the cam interlocking member 85 is pushed by the rotational cam 86 to move away from the driving roller 62 as indicated by the arrow j in FIG. 6B.

When the cam interlocking member 85 moves this way, the upper-end support shaft 97 of the rotating member 95 supported and coupled to the cam interlocking member 85 is pulled by the movement of the cam interlocking member 85, and is rotated downstream of the intermediate transfer belt 47 in the transfer running direction indicated by the arrow h to move away from the driving roller 62 by an angle matching the amount of movement of the cam interlocking members 85 with the to-be-supported shaft 96 at the lower end as the fulcrum.

According to the rotation, the upper-end support shaft 97 of the rotating member 95 is moved down while moving downstream while drawing the moving locus of an arc 98 from the top of the rotating path. Then, the cam interlocking member 85 supported by the support shaft 97 is also moved down while moving downstream along the same locus as the arc 98. As a result, the primary transfer roller 64 held by the cam interlocking member 85 is also moved down while moving downstream along the same locus as the arc 98.

A distance n between the point of support of the support shaft 97 of the rotating member 95 and the to-be-supported point of the to-be-supported shaft 96 is the same as a distance m between the arc 88 and the rotational axial center 83 of the photosensitive drum 49 when the rotational shaft 82 of the primary transfer roller 64 is coupled to the rotational shaft of the photosensitive drum 49 via the coupling member 84 and is moved along the locus of the arc 88 of the rotating motion with the rotational axial center 83 of the photosensitive drum 49 as the fulcrum in FIGS. 4A and 4B. That is, n=m.

Since the amount of movement of the cam interlocking member 85 in FIGS. 6A and 6B is the same as that in the case of FIGS. 4A and 4B, and n=m in FIGS. 6A and 6B as mentioned above, the length of the arc 98 along which the upper-end support shaft 97 of the rotating member 95 rotates is the same as the length of the arc 88 drawn by the rotation of the primary transfer roller 64 in FIGS. 4A and 4B.

The cam interlocking member 85 supported on the upper-end support shaft 97 of the rotating member 95 draws an arc with the same length as that of the arc 88, so that the primary transfer roller 64 held on the cam interlocking member 85 in this embodiment moves drawing an arc with the same length as that of the arc 88 in FIGS. 4A and 4B.

Having described and illustrated the principles of this application by reference to three preferred embodiments, it should be apparent that the preferred embodiments may be modified in arrangement and detail without departing from the principles disclosed herein and that it is intended that the application be construed as including all such modifications and variations insofar as they come within the spirit and scope of the subject matter disclosed herein.

What is claimed is:

1. An image forming apparatus comprising:

a primary transfer roller disposed opposite to a photosensitive drum with an intermediate transfer belt in between to carry out primary transfer of a toner image on the photosensitive drum to the intermediate transfer belt, wherein when moving from a non-transfer position to a transfer position to carry out the primary transfer of the toner image onto the intermediate transfer belt, the primary transfer roller is moved along a locus of a rotational motion about a rotating shaft of the photosensitive drum as a fulcrum so that the transfer position is set to a position shifted downstream in a belt moving direction from a position of contact between the photosensitive drum and the intermediate transfer belt by a predetermined distance.

2. The image forming apparatus according to claim 1, wherein the primary transfer roller has a rotating shaft coupled to the rotating shaft of the photosensitive drum by a coupling member, the rotating shaft of the primary transfer roller is coupled to the coupling member and a cam interlocking member disposed in a belt unit, the cam interlocking member is moved back and forth by a rotating cam in contact with a cam surface thereof in a slidable manner, and the coupling member causes the rotating shaft of the primary transfer roller to move along an arc locus of the rotational motion about the rotating shaft of the photosensitive drum as the fulcrum according to the forward/backward movement of the cam interlocking member.

3. The image forming apparatus according to claim 1, further comprising at least two rotating members, wherein the primary transfer roller is held by a cam interlocking member disposed in a belt unit, the cam interlocking member is moved back and forth by a rotating cam in contact with a cam surface thereof in a slidable manner, and is supported by support shafts on one ends of the rotating members at a side surface at right angles to a direction in which the cam interlocking member is moved forward and backward, supported shafts on other ends of the rotating members are fixed to a frame of the belt unit to be rotatably supported, and a distance between a point of support of the support shaft and a supported point of the supported shaft being equal to a distance between the center of the rotating shaft of the photosensitive drum and an arc of an arc locus, along which the rotating shaft of the primary transfer roller moves, of the rotational motion about the rotating shaft of the photosensitive drum as the fulcrum.

* * * * *